US006158873A

United States Patent [19]

Griffiths

[11] Patent Number: 6,158,873

[45] Date of Patent: Dec. 12, 2000

[54] UNDERWATER LIGHT

[76] Inventor: John M. Griffiths, 251 Tompkins Rd., Montgomery, N.Y. 12549

[21] Appl. No.: 09/170,912

[22] Filed: Oct. 13, 1998

Related U.S. Application Data

[60] Provisional application No. 60/061,597, Oct. 10, 1997.

[51] Int. Cl.[7] ..... F21L 4/00

[52] U.S. Cl. ..... 362/158; 362/109; 362/187; 362/188; 362/198; 362/203; 200/60

[58] Field of Search ..... 362/158, 202, 362/109, 187, 188, 203, 198; 200/60

[56] References Cited

U.S. PATENT DOCUMENTS

D. 403,453 12/1998 Shiau ..... D26/43
3,850,210 11/1974 Buxton ..... 141/312
4,441,142 4/1984 Garofalo ..... 362/158
5,345,370 9/1994 Murray et al. ..... 362/205

*Primary Examiner*—Thong Nguyen
*Assistant Examiner*—Craig Curtis
*Attorney, Agent, or Firm*—Fitzpatrick, Cella, Harper & Scinto

[57] ABSTRACT

An underwater light has a head assembly including a reflector, a light source located in the head assembly and movable relative to the reflector, a housing that moves relative to a slide that engages the switch such that it is twist activated. Continued twisting adjusts the position of the light source to adjust beam spread. Bearings are included in the head assembly to allow the twisting action to be effected under high pressure, while o-ring seals prevent leakage.

12 Claims, 5 Drawing Sheets

UNDERWATER LIGHT

CROSS REFERENCE TO RELATED APPLICATION

This application claims priority in provisional Application Ser. No. 60/061,597 filed on Oct. 10, 1997 now pending.

TECHNICAL FIELD

The present invention relates to the field of hand held sealed portable lighting equipment used underwater and electrical power sources for underwater applications.

BACKGROUND

Underwater lighting equipment and electrical power sources are known. However, due to the inherent problems associated with an underwater environment, such as pressure, temperature and corrosiveness, the presently available portable lights and power sources have suffered from frequent failure and poor performance.

Current portable lights have an inefficient light head requiring a high wattage light source to produces a sufficient usable lumen resulting in greater power source requirements and decreased burn times. Further, lights employing reflectors that are exposed to the water are subject to deterioration, and are detrimentally effected by particulate matter in the water that blocks light transmission distorting and diffusing the beam from the light.

Additionally, present light systems are difficult to operate in the underwater environment. Some portable lights feature a switch on the power source that protrudes from the power source through a housing into the surrounding environment. Such a switch is often accidentally actuated resulting in unnecessary power source drain or lighting loss, which can be potentially hazardous to the user. If the switch is guarded, it can often be difficult to actuate in the underwater environment where a user must frequently wear gloves or mitts.

Many lights having toggle switches covered by a rubber boot to seal the battery from the environment. However, this boot is subjected to normal wear and abrasion, and eventually breaches causing the power source to flood with consequent damage to the power source and light components. Some lights have two portions which rotate relative to each other, for twist activating the light. However, these are deficient as metal contacts are subject to oxidation and corrosion; grounding to metal light parts could ultimately shock the user, and the twist mechanisms become difficult to use due to water pressure fluctuations as the user varies depth, the difficulty increasing with depth.

Further, most underwater light source produce only one beam pattern of light when in use, either a spot, flood or combination spot bright center with a broader flood pattern, that can not be altered during use.

Additionally, power sources currently available employ internal fuse mechanisms that break the circuit if a short occurs in the power source resulting in complete power failure during use. To correct this, the power source must be accessed in a dry environment to avoid further damage or flooding and replaced. In remote environments, such as on dive boats, if a replacement fuse is unavailable, the light source can not be used thereafter. Further, the connectors currently employed in the art are subject to oxidation resulting in decreased efficiency, increased heat production and the potential for fire or short circuiting.

Further, current lighting systems do not have a sealed solid flexible connecting cable that prevents damage to the light head, power source and function of the unit in the event that the cord covering is cut or otherwise ruptured during use.

In addition, current lighting systems do not have a sealed solid flexible cable that is resistant to pressure preventing the cable from extruding and flowing at high pressure resulting in damage to the light head, power source and function of the unit.

SUMMARY OF THE INVENTION

It is an object of the present invention to provide an underwater light that can be easily actuated underwater to provide light in a water environment.

It is a further object to prevent water damage to the internal elements and parts of the light head, cable and power source.

If is a further object to provide an efficient light source which requires less power during use.

It is a further object to provide an underwater light source having a light beam adjustable from a spot to a flood patter, in use.

It is a further object to provide an underwater light source which is resistant to corrosion, oxidation and the pressure of the underwater environment.

It is a further object to provide a power source which is automatically reset when a short has ended.

These and other objects of the present invention are achieved by an underwater light comprising a head assembly having a reflector coated to optimize reflection, a light source disposed in the head assembly and movable relative to the reflector to adjust beam spread, the light having non-pressure sensitive twist activation means, bearing means for preventing binding of the twist activation means, power source means and cable means for connecting the power source to the head assembly.

In another embodiment of the invention, the underwater light twist actuation means incorporates an internal oxidation resistant switch, preferably, a solid state switch, the terminals and connectors, having a non-oxidizing coating thereon. Optionally, the underwater light has means responsive to shorts which interrupt power and automatically reset underwater without necessitating access to the internal components.

Preferably, the light head assembly has a plurality of pressure resistant seals which prevent fluid leakage while allowing rotative motion of the activation means, at any depth.

DETAILED DESCRIPTION OF THE DRAWING

Figure 1:
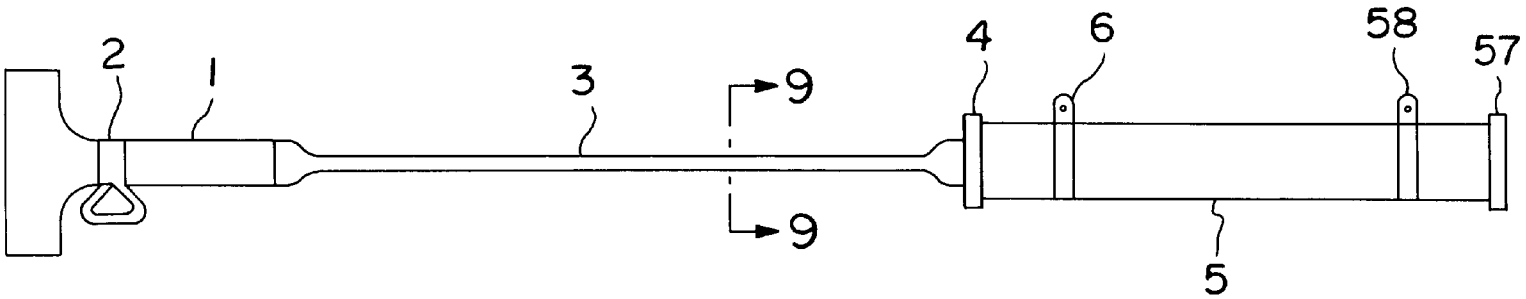
FIG. 1 is a front view of the underwater light in accordance with the present invention.
Figure 9:
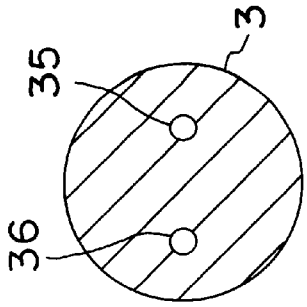
FIG. 9 is a cable cross section taken along Line 9—9 of FIG. 1.

Referring to FIG. 1, a sealed light head assembly 1 has a handle 2 and is attached to a sealed solid flexible connecting cable 3, which encapsulates wires 35 and 36, see FIG. 9, of course, 2 or more wires can be used. The sealed flexible cable is distally mounted to one end cap 4 of a cylindrical container 5 for holding batteries (not shown). A second end cap 57 is attached to the distal end of the cylindrical container and allows access to the battery for maintenance and charging. Two optional mounting bands 6 and 58 attach to the cylindrical container and allow the user to attach the battery container to a buoyancy compensating device or other equipment during use.

Figure 2:
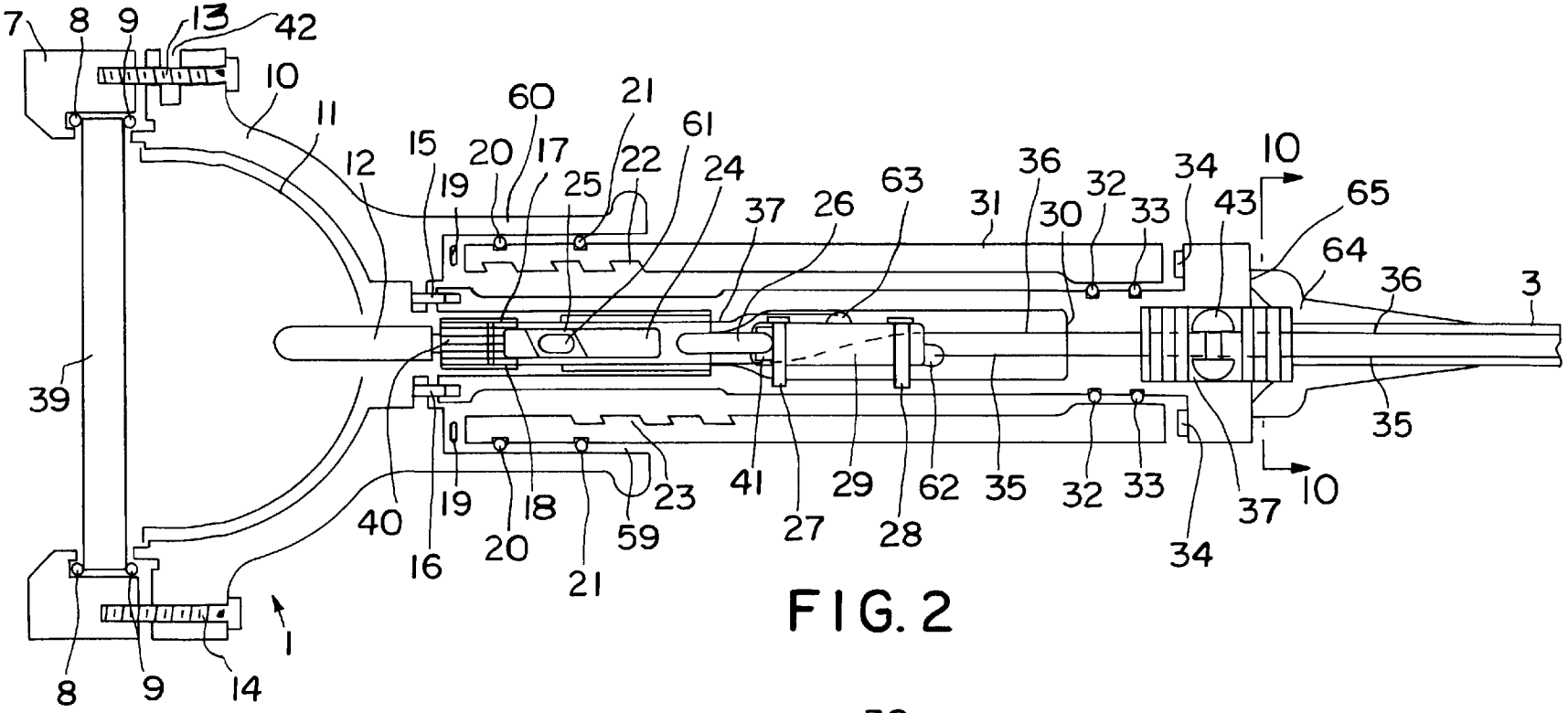
FIG. 2 is an enlarged view of the sealed light head.

Referring to FIG. 2, the head assembly 1 has a lens 39 mounted to a light head 10 by a lens retainer 7 with a plurality of screws 13 and 14. The lens 39 is sealed to the light head 10 by o-rings 8 and 9. The light head 10 has a clip retainer 42 for attaching a mounting device. Light head 10 contains a reflector 11 which focuses light illuminated by a bulb 12. Bulb 12 is inserted into a light socket 40 which is mounted by screws 17 and 18 in a slide 24 having a finger 26, see also FIG. 5, that depresses a lever 41 on a switch 29. The switch 29, such as Micro Switch V3-1 10-15A or equivalent, which can be obtained from Honeywell, is mounted by screws 27 and 28 on an inner handle 30. The inner handle 30 is mounted to the light head 10 by screws 15 and 16. A small opening 59 defined by a side wall 60 rotatably receives the outer handle 31. The resistance to outer handle 31 turning against the light head 10 and the inner handle 30 is reduced by bearings 19 and 34 which may comprise TEFLON® (polytetrafluoroethylene or PTFE) washers. The washers may be composed of a material selected from the group consisting of TEFLON (polytetrafluoroethylene), silicone and combinations thereof.

Figure 10:
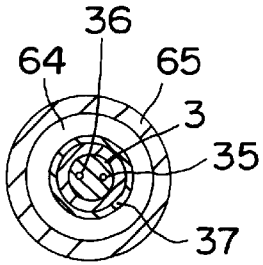
FIG. 10 is a cable cross section taken along Line 10—10 of FIG. 2.

Water is prevented from entering the sealed light head assembly 1 between the light head 10 and outer handle 31 by o-rings 20 and 21, and between the inner handle 30 and outer handle 31 by o-rings 32 and 33. The inner handle 30 has a second clip retainer 43 at the distal end. The sealed solid flexible connecting cable 3 is attached to the inner handle 30 by threaded end fitting 37. The cable 3 and the fitting 37 are encased in a handle rubber sheath 64, see FIG. 10, by vulcanization or an equivalent process, and the wires 35 and 36 are sealed in the fitting 37 by epoxy or an equivalent compound thereby sealing the cable 3 from inner handle 30. The sheath 64 is conically shaped around fitting 37 defining handle sealing surface 65. The conical shape of the sheath 64 allows for a better seal of the surface 65 to inner handle 30 because it engages the increased diameter for better sealing when fitting 37 is turned into inner handle 30. Wire 36 enters the inner handle 30 from the cable 3 and attaches to the light socket 40. Wire 35 enters the inner handle 30 from the cable 3 and attaches to the switch 29 on a power terminal 62. Wire 38 attaches from the switch 29 on a bulb terminal 63 to the light socket 40. The slide 24 is mounted with a slide dog 25, see also FIG. 5, by screw 61. Slide dog 25 protrudes from an aperture defined by the inner handle 30 and connects with threads 22 and 23, see also FIG. 7, on the inner diameter of the outer handle 31, see also FIG. 8, thus moving the slide when the outer handle 31 is rotated causing slide finger 26 to depress or release level 41 of switch 29 and allowing bulb 12 to move in relation to reflector 21.

Figure 3:
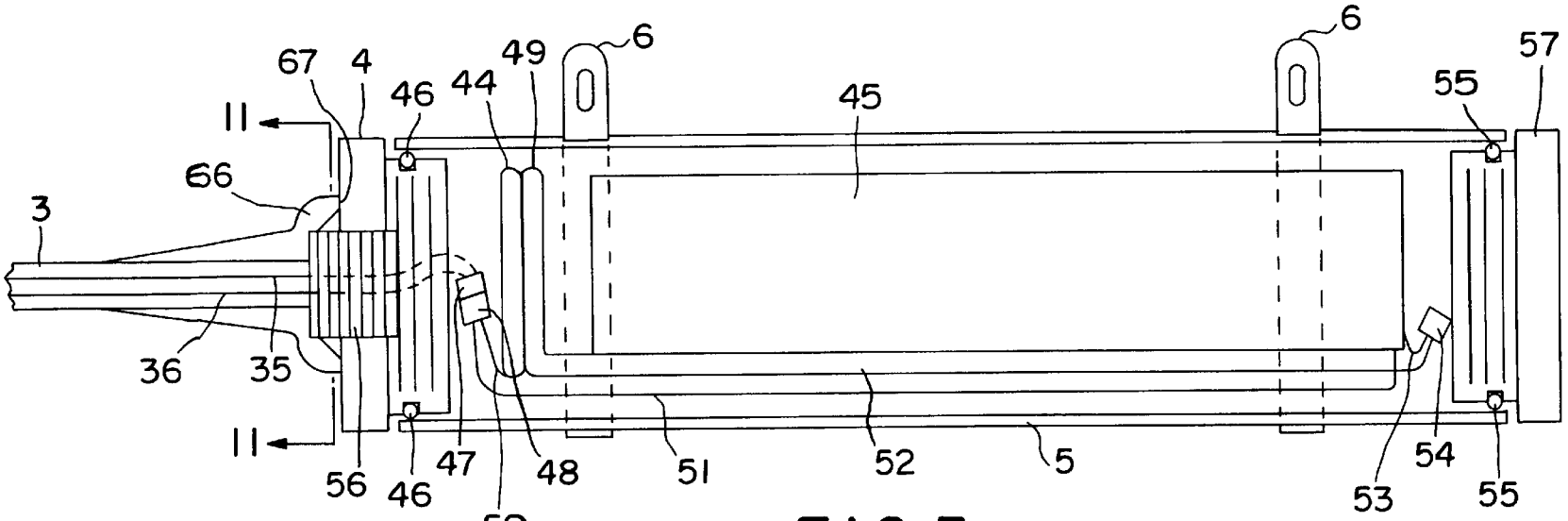
FIG. 3 is an enlarged view of the sealed power source.
Figure 11:
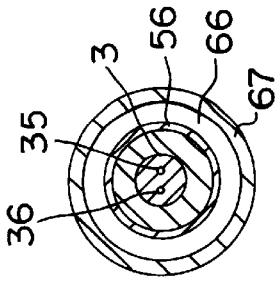
FIG. 11 is a cable cross section taken along Line 11—11 of FIG. 3.

Referring to FIG. 3, the sealed container 5 which holds a power source 45 is mounted with end caps 4 and 57. Water is prevented from entering the sealed container through the end caps by o-rings 55 and 46. The sealed solid flexible connecting cable 3 is mounted in end cap 4 by a battery connector 56. The cable 3 and connector 56 are encased in a power rubber sheath 66, see FIG. 11, by vulcanization or an equivalent process, and the wires 35 and 36 are sealed in the connector 56 by epoxy or an equivalent compound, thereby sealing the cable 3 from the sealed container 5. The sheath 66 is conically shaped around connector 56 defining a power sealing surface 67. The conical shape of sheath 66 allows for a better seal of the surface 67 to the end cap 4 because it engages the increased diameter for better sealing when connector 56 is turned into cap 4. Wires 35 and 36 engage an end plug 47, which plugs into a battery plug 48. Wire 50 attaches battery plug 48 to a reset switch 44 such as Raychem RUE 800 Polyswitch or equivalent. This switch automatically detects faults and resets once the fault is cured. Reset switch 44 is joined to power source 45 by wire 49. Wire 52 joins the reset state switch 44 to a charging plug 54. Wire 53 connects charging plug 54 to power source 45. Wire 51 connects power source 45 to batter plug 48. Mounting bands 6 are clamped to sealed container 5.

Figure 4:
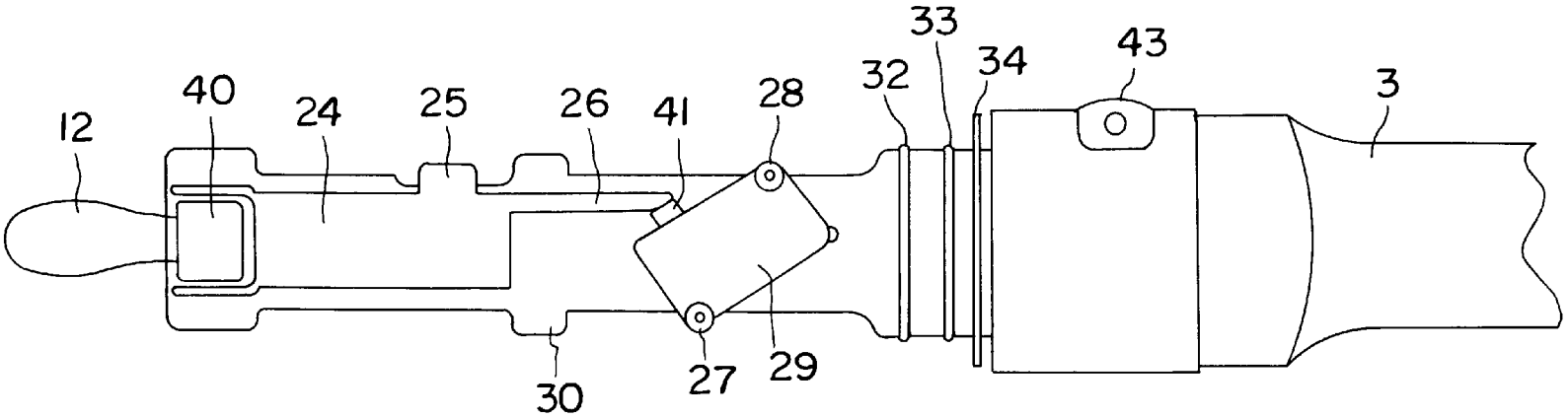
FIG. 4 is an enlarged view of the inner handle, activating mechanism and beam adjustment mechanism.
Figure 5:
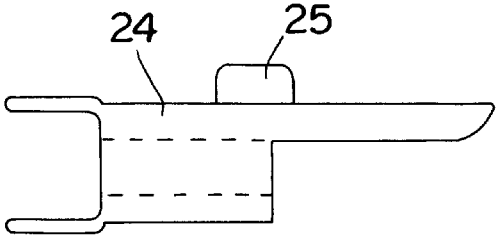
FIG. 5 is an enlarged view of the slide.

Referring to FIG. 4, the inner handle 30 is attached to the sealed solid flexible connecting cable 3. Slide 24 is slidably received in the inner handle 30 allowing slide 24 to move laterally within the inner handle 30. Slide dog 25 having a slide FIG. 26, see also FIG. 5, is mounted to slide 24 and protruding through an aperture in the inner handle 30 thereby limiting the lateral movement of slide 24 in the inner handle 30. Light socket 40 mounts in the end of slide 24 holding bulb 12. As slide 24 moves in the inner handle 30, the bulb 12 moves in relation to the reflector 11 and the slide finger 26 moves in relation to lever 41 of the switch 29. As the bulb 12 moves in relation to reflector 11, the beam of light adjusts between a spot and a flood. As the slide finger 26 moves in relation to lever 41, the lever 41 is depressed deactivating switch 29 turning off the light, and lever 41 is released activating switch 29 turning the light on. Switch 29 is mounted in the inner handle by screws 27 and 28. O-rings 32 and 34 and bearings 34 are shown. Second clip retainer 43 is shown on the distal end of inner handle 30.

Figure 6:
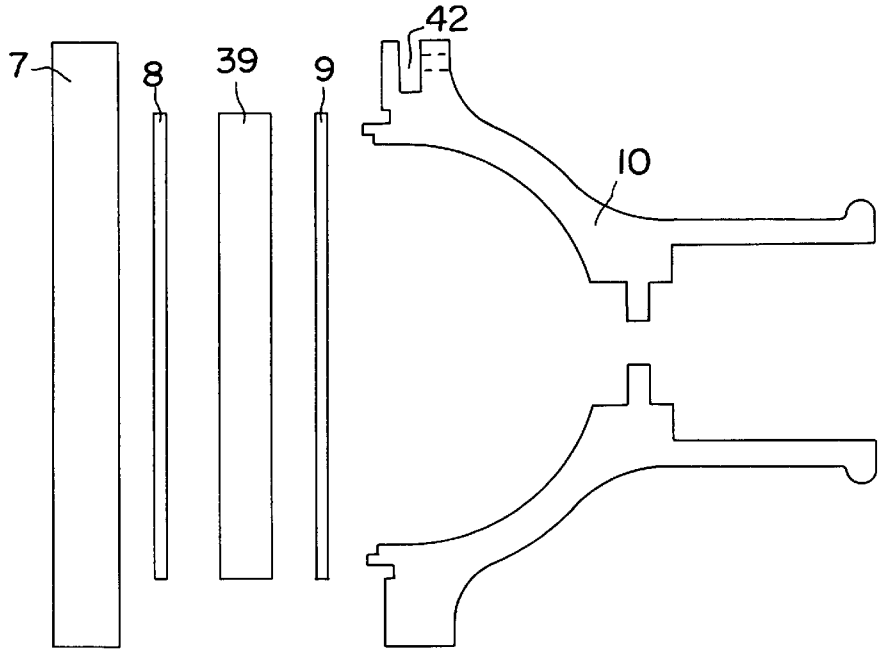
FIG. 6 is an enlarged view of the light head.

Referring to FIG. 6, a light head 10 is sealed by o-rings 8 and 9 which are positioned on the inner and outer sides of lens 39. The o-ring 8 and 9 and lens 39 are held against light head 10 by lens retainer 7.

Figure 7:
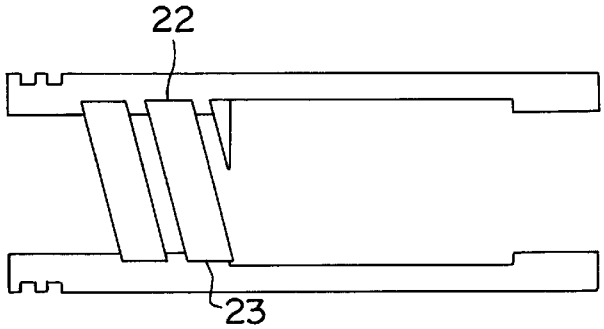
FIG. 7 is an enlarged view of the inner diameter of the outer handle.
Figure 8:
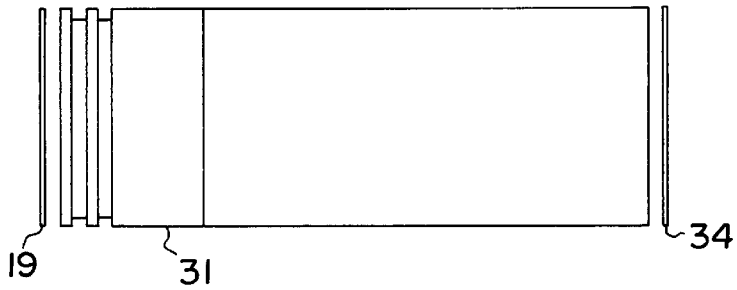
FIG. 8 is an enlarged view of the outer handle.

FIG. 7 shows the outer handle 31 in cross section, illustrating the threads which move the slide 24. FIG. 8 shows the outer handle 31 with a knurled outer surface for gripping, as the outer handle is twisted.

In a preferred embodiment, the underwater light has a sealed light head assembly, a solid internal flexible connecting cable joining the assembly to the housing for a power source. The sealed power source has polarized non-oxidizing connectors, which can be obtained from Molex and AMP, treated with a non-oxidizing agent, preferably tin, joined to a battery and a reset switch. Two end caps employ a plurality of o-rings for closing the ends of the power source container. One end cap has an aperture for receiving an end of the solid connecting cable, the light head joined to an opposite end of the connecting cable. The light head has a lens retainer; a lens; a plurality of o-rings; a plurality of bearing washers; a reflector; a bulb; a handle; a light head; a slide that contains a light socket on one end that a bulb is mounted in and a finger at the opposite end of the slide that activates a switch that is mounted in the inner handle. A slide dog protrudes from the inner handle and contacts threads on the inner diameter of the outer handle. When the outer handle is rotated, for example counter-clockwise, the slide dog and assembly move forward causing the tapered finger to move off the lever of the switch, energizing the bulb, the bearings avoiding pressure induced resistance to twisting. When the lever on the switch is in the up position, the bulb is activated. Further, when the light is initially turned on, it is in the spot beam mode and continued turning of the outer handle counter-clockwise will cause the bulb to move within the reflector parabola, gradually widening the beam pattern. By rotating the handle clockwise, the above-describe procedure is reversed, the beam pattern is altered from the flood beam pattern to a narrow beam pattern until the light is turned off when the finger on the slide depresses the lever on the switch.

The housing is preferably made of 6061 aluminum, hard coat anodized for damage and corrosion resistance. The reflector, to assist in maximizing light utilization is preferably coated with a high purity ladle analysis aluminum that has a high reflection rate of about 98%.

The present invention overcomes the problems of the prior art by employing a unique reflector which optimally interacts with the light source to allow use of a lower wattage lamp that produces more usable lumens than currently available higher wattage systems. The reflector and light source are located in an environmentally sealed head assembly to eliminate contact with the surrounding water.

By employing a non-pressure sensitive twist mechanism, that actuates an internal, oxidation resistant switch, a diver may activate the light and adjust beam spread without resistance at any depth, from spot to broad flood pattern.

The inventive light has an internal mechanism that allows the bulb to focus within the reflector in a sealed light head for a narrow spot pattern, the bulb position adjustable, relative to the reflector to a broad flood pattern while in use in water under any pressure condition.

Utilizing a reset switch that becomes non-conductive when a higher than acceptable amperage or short is detected, allows automatic resetting and a return to a conductive condition when an acceptable amperage is present or the short has ended, without any action by the user.

Additionally, by sealing the wires and end connectors in the connecting cable by integrating these components into a solid flexible medium, such as rubber, and by intergrating a solid ridged compound, such as epoxy, between the wires and connectors at the power source and light head, any cut or rupture of the cable does not allow water to pass through the cable to the power source or the light head. Consequently, the light will continue to function underwater if the cord is only partially cut or ruptured.

Further, by sealing the wires and end connectors in the connecting cable by integrating these components into a solid flexible medium, such as rubber, and by intergrating a solid ridged compound, such as epoxy, between the wires and connectors at the power source and light head, the sealed cable is resistant to pressure, because its solid flexible medium and solid ridged compound prevent it from extruding or flowing at high pressure which can be detrimental to the light head, the power source, the connecting cable and the function of the unit.

Using the invention, a 30 watt bulb can be used to provide illumination comparable to a 75 watt bulb, substantially reducing power consumption without reducing light efficiently. 10 or 20 watt bulbs could also be used, the light powered by batteries of preferably 6 to 12 volts.

While preferred embodiments of the invention have been shown and described, it will be understood by those skilled in the art that various changes or modifications can be made without varying from the scope of the invention.

I claim:

1. An underwater light comprising a head assembly having a reflector, a light source disposed in the head assembly and movable therein relative to the reflector, an inner handle in which the light source is mounted having twist activation means for activating the light source, the inner handle being movable for moving the light source relative the reflector, an outer handle surrounding the inner handle, a switch mounted in the head assembly, the inner handle having a slide means engaged to the switch, the slide means longitudinally movable in response to a twisting action acting on the inner handle, the outer housing rotatably engaged to the slide means mounted in the head assembly, flat bearing means positioned for supporting rotation of the outer handle to prevent binding of the outer handle due to water pressure, wherein rotation of the outer handle longitudinally moves the inner handle to activate the light source and move the light source relative to the reflector.

2. The underwater light of claim 1 further comprising a power source, connected to the head assembly.

3. The underwater light of claim 1 further comprising a flexible cable connected at one end through the head assembly to the light source and at a second end to a power source.

4. The underwater light of claim 3 wherein the cable is solid containing conductive leads internal therewith.

5. The underwater light of claim 1 further comprising means for detecting a fault condition, for interrupting power flow and for automatically resetting once the fault condition is cured.

6. The underwater light of claim 1 wherein the friction reducing washers are composed of a material selected from the group consisting of teflon, silicone and combinations thereof.

7. The underwater light of claim 1 further comprising means for watertight sealing the head assembly.

8. The underwater light of claim 2 wherein the power source comprises a power source housing, at least one battery disposed in the power source housing.

9. The underwater light of claim 8 further comprising terminals and connectors for supplying power to the light source, the terminals and connectors having a non-oxidizing plating thereon.

10. The underwater light of claim 8 further comprising means for watertight sealing the power source housing.

11. An underwater light comprising a head assembly having a reflector, a light source disposed in the head assembly and movable therein relative to the reflector, an inner handle in which the light source is mounted having twist activation means for longitudinal movement to activate the light source and for moving the light source relative to the reflector, a twistable outer handle engaged to the slide means of the inner handle, bearing means disposed for engagement with the twist activation means to prevent binding of the twist activation means due to water pressure, the bearing means being friction reducing washers.

12. A method for delivering light under water comprising:

providing an underwater light having a head assembly having a reflector, a light source disposed in the head assembly and movable therein relative to the reflector, an inner handle in which the light source is mounted having twist activation means for activating the light source, the inner handle being movable for moving the light source relative to the reflector, and outer handle surrounding the inner handle, a switch mounted in the head assembly, the inner handle having slide means engaged to the switch, the slide means longitudinally movable in response to a twisting action acting on the inner handle, the outer housing rotatably engaged to the slide means mounted in the head assembly, flat bearing means positioned for supporting rotation of the outer handle to prevent binding of the outer handle due to water pressure, wherein rotation of the outer handle longitudinally moves the inner handle to activate the light source and moves the light source relative to the reflector; and twisting the outer handle to activate the light source and further twisting the outer handle to adjust the beam spread from spot to broad flood.

* * * * *